United States Patent [19]

Field et al.

[11] Patent Number: 4,708,750

[45] Date of Patent: Nov. 24, 1987

[54] THERMAL TREATMENT OF WROUGHT, NICKEL BASE SUPERALLOYS IN CONJUNCTION WITH HIGH ENERGY HOLE DRILLING

[75] Inventors: Thomas T. Field, East Killingly; Thomas A. Murrin; Earle A. Ault, both of South Windsor, all of Conn.

[73] Assignee: United Technologies Corporation, Hartford, Conn.

[21] Appl. No.: 812,107

[22] Filed: Dec. 23, 1985

[51] Int. Cl.[4] ..... C22F 1/10

[52] U.S. Cl. ..... 148/11.5 N; 148/11.5 Q; 148/12.7 N; 148/127; 148/427; 148/428

[58] Field of Search ..... 148/11.5 N, 12.7 N, 148/127, 427, 428, 11.5 Q

[56] References Cited

U.S. PATENT DOCUMENTS 4,490,186 12/1984 Sines et al. ..... 148/127

*Primary Examiner*—R. Dean

*Attorney, Agent, or Firm*—James M. Rashid

[57] ABSTRACT

A heat treatment is described for producing a desired microstructure in Hastelloy Alloy X components which have small diameter, closely spaced, laser pierced holes therein. The heat treatment produces a small grain size and discontinuous carbide morphology in the component prior to the hole piercing operation, which reduces the propensity for cracking which has been found to be associated with the hole piercing operation. After the piercing operation, the component is heat treated again to increase the grain size and produce a microstructure which provides the optimum balance of creep strength and fatigue strength.

10 Claims, 3 Drawing Figures

1900°F 2000X

2075°F 2000X

2150°F 2000X

THERMAL TREATMENT OF WROUGHT, NICKEL BASE SUPERALLOYS IN CONJUNCTION WITH HIGH ENERGY HOLE DRILLING

TECHNICAL FIELD

The present invention relates to the heat treatment of wrought, nickel base superalloys. In particular, the present invention relates to a heat treatment to produce a desired microstructure in wrought, nickel base superalloy articles having closely spaced holes pierced by a high energy beam.

BACKGROUND ART

In a gas turbine engine, the burning of fuel takes place within a combustor. As is shown in U.S. Pat. Nos. 4,077,205 and 4,380,906, some combustors are comprised of a plurality of annular, mating louver details or members. Each louver member has a plurality of circumferentially disposed holes therein to admit a film of cooling air into the interior of the combustor. This film of cooling air limits the temperature to which the louver members are heated by hot gases formed during the combustion process.

It is essential for optimum cooling effectiveness that this film of air, which forms a protective boundary between each louver member and the hot stream of combustion gases, be as continuous as possible. As a result, designs have been proposed in which the cooling holes are closely spaced apart, and each hole as a very small diameter.

One technique for forming such holes uses a high energy beam, preferably a laser beam. In a hole piercing operation using a laser beam, the individual louver member is rapidly moved, or indexed, into position under the beam, then a shutter placed between the beam source and louver member opens for a predetermined interval to allow the beam to impinge upon the member and pierce the hole. By this method, many holes may be pierced in the louver member in a short period of time. However, it has been found that such rapid rate piercing of small diameter holes sometimes results in the formation of cracks which initiate at the hole surface and propagate into the substrate material. It is believed that the cracks may result from thermal shocking, which occurs as a result of the rapid laser piercing operation. Due to the severe environment in which a combustor in a gas turbine engine operates, these cracks should be minimized, in order to avoid an unacceptable debit in mechanical properties. The present invention results from a development program to define procedures for the laser piercing of closely spaced, small diameter holes in wrought, nickel base superalloy louver members without the formation of such cracks.

DISCLOSURE OF THE INVENTION

An object of the present invention is to provide a method for processing a wrought, polycrystalline nickel base superalloy article, such that during the laser piercing of small diameter, closely spaced holes in the article, cracking associated with the formation of the holes is limited.

Another object of the invention is to produce a crack free film cooled combustor for a gas turbine engine having good creep strength and good fatigue strength.

According to the invention, a method for producing a plurality of small diameter, closely spaced apart holes in a wrought, polycrystalline, carbide forming nickel base superalloy article includes the steps of heat treating the article at conditions to produce therein a small grain size of about ASTM No. 6–9 (average grain diameter about 16–45 microns) and a discontinuous carbide phase precipitate along the grain boundaries, and then piercing the holes with a high energy beam. Then, the article is heat treated at conditions to increase the grain size to about ASTM No. 4–8 (average grain diameter about 22–90 microns). Such processing has been shown to suppress cracking during, or as a result of, the hole piercing operation, and to produce an article having a good balance of fatigue strength and creep strength.

In one aspect of the invention, HASTELLOY® Alloy X louver members for a gas turbine engine combustor are heat treated at about 1,020°–1,050° C. (1,870°–1,920° F.) for about 15 minutes prior to the hole piercing operation; such a heat treatment produces a microstructure characterized by an average grain size of ASTM No. 6–9 and a substantially discontinuous carbide phase precipitate along the grain boundaries. After the piercing operation which uses a high energy laser, the louver members are welded together to form the combustor, and the assembled combustor is then heat treated at about 1,135°–1,160° C. (2,075°–2,125° F.) for about one hour to increase the grain size to ASTM No. 4–8. This grain size provides the proper balance of creep strength and fatigue strength for a combustor operating in a gas turbine engine.

The foregoing and other objects, features and advantages of the present invention will become more apparent in the light of the following detailed description of the preferred embodiments thereof as illustrated in the accompanying drawing.

BEST MODE FOR CARRYING OUT THE INVENTION

Figure 1A:
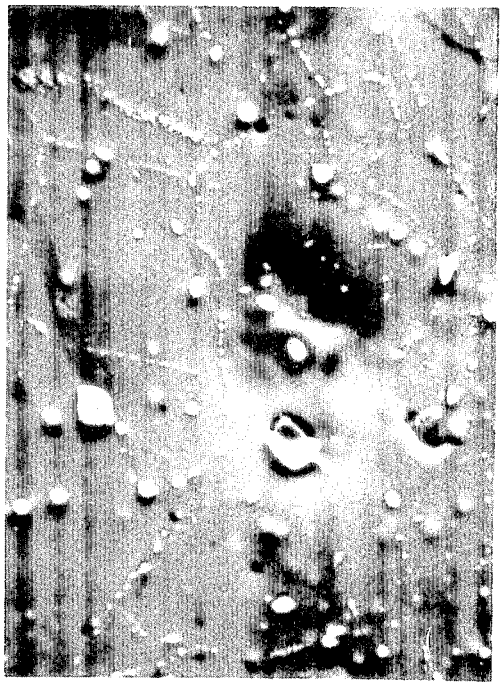
FIG. 1*a* is a photomicrograph (2000X) of a HASTELLOY Alloy X louver member heat treated at about 1,040° C.

The invention is described in terms of the fabrication of a combustor for a gas turbine engine. However, it will be appreciated that the invention will be useful in the manufacture of other polycrystalline, carbide containing components having small diameter, closely spaced apart holes which are formed by a high energy laser beam.

The well known nickel base superalloy designated HASTELLOY Alloy X is commonly used to fabricate combustors for gas turbine engines. HASTELLOY is a trademark of Cabot Corporation. Hereinafter, HASTELLOY Alloy X will be referred to as Hastelloy X. The composition range of Hastelloy X, by weight percent, is 20.5–23.0 Cr, 0.5–2.5 Co, 17 –20 Fe, 8–10 Mo, 0.2–1.0 W, 0.05–0.15 C, 0–0.01 B, 0–1.0 Mn, 0–1.0 Si, 0–0.014 P, 0–0.030 S, balance Ni. This material is a wrought product commonly available in sheet and mill forms under Aerospace Materials Specification (AMS) 5536, AMS 5754. A typical alloy composition is about 22 Cr, 1.5 Co, 18.5 Fe, 9 Mo, 0.6 W, 0.1 C, with the balance Ni.

As described in the above referenced U.S. Pat. No. 4,380,906, a combustor comprises a plurality of louver members which are welded together to form a hollow combustion chamber. One method for forming the individual louver members is described in commonly assigned U.S. Pat. No. 4,476,194, which is incorporated by reference. Therein, two metal pieces (subdetails) are contour rolled to a desired shape, in-process annealing at 1,125°-1,175° C. (2,050°-2,150° F.) being used to reduce the propensity for cracking of the subdetails during the rolling operation. Then, the subdetails are circumferentially welded to each other to form a detail. Finally, the welded detail is again contour rolled and formed into the combustor louver member, which has the shape of a truncated cone. Commonly assigned U.S. Pat. No. 4,490,186, also incorporated by reference, discloses a preferred method for forming the welded details into the truncated cone. First, the detail is cold worked to reduce the cross section of the weldment which joins the subdetails by at least 5%. Then, the detail is annealed between 1,125°-1,175° C. The combination of cold working and annealing within this temperature range results in recrystallization of the weld, without causing excessive grain growth in the detail microstructure. The resulting grain size in the overall detail (including the weld area) is ASTM No. 4-8, which was found to provide the best balance of fatigue strength and creep strength for a gas turbine engine combustor louver member.

However, it has subsequently been determined that when louver members are fabricated according to the methods described in the aforementioned patents, and holes for providing film cooling are pierced using a high energy laser, the members suffer from extensive cracking in the base metal which initiates at the hole surface, and typically propagates in an intergranular fashion (i.e., along grain boundaries).

To determine the cause of the base metal cracking, an extensive program was conducted to determine the effect of various processing parameters associated with the laser piercing operation on the formation of cracks. With the exception of examining the effects of Hastelloy X grain size, all of the other parameters which were evaluated were concerned with the actual laser piercing operation. A discussion of the parameters which were evaluated is presented below:

(a) Typically, protective coatings such as boron nitride, silicon oil, or titanium oxide have been used to prevent the metal expelled from the hole during the piercing operation from resolidifying on the base metal. To determine whether any of these coatings contributed to the observed cracking, piercing trials were conducted with and without such coatings applied to the base metal surface.

(b) The length of time that the shutter is open (termed the shutter speed) determines the length of time that the laser beam impinges upon the base metal. To produce a constant sized hole, a lower power level requires a longer shutter speed, and a higher power level requires a shorter shutter speed. Tests were conducted at two different shutter speeds, with the power levels adjusted accordingly to produce the same size hole. Tests were also conducted to evaluate the effect of different power levels, and to determine if the delay time (i.e., the time between successive shutter openings) had an effect on base metal cracking.

(c) Mirrors and lenses which direct the laser beam onto the surface of the louver member are subject to the gradual accumulation of dirt and degradation of their surface finish during the piercing operation. This diminishes the ability to focus the beam, and decreases the quality of the hole which is being pierced. Tests were conducted to examine the propensity of dirty mirrors and lenses to cause base metal cracking.

(d) In the laser beam apparatus currently used, at the point where the beam impinges upon the louver member, the beam is focused to a minimum diameter of about 1 mm. To pierce a larger diameter hole, the beam is reflected from a rotating mirror, which controls and directs the beam in a near circular path to pierce the full diameter hole. Tests were conducted to determine whether there was any effect of mirror rotation speed on base metal cracking.

(e) Ejection of molten metal from the hole is assisted by jets of compressed air which impinge on the surface of the louver at the site of the hole. To evaluate the effect of various air jet pressures, tests were conducted at various gas pressure levels. The nozzle which directs this stream of pressurized air onto the louver is subject to erosion during operation of the laser, caused by the molten metal which is expelled from the hole and which strikes the nozzle. Since erosion of the nozzle alters the geometry of the air jet, tests were also conducted to determine if base metal cracks had a greater tendency to form when eroded nozzles were used, as compared to the use of new (undamaged) nozzles.

(f) To determine if the spacing between adjacent holes had any effect on base metal cracking, tests were conducted in which the distance between the center of adjacent holes (2 mm diameter) was varied.

(g) Finally, the effect of two geometric relations between the laser beam and workpiece were examined: first, the angle of the impinging beam relative to the louver member, and second, the distance between the beam focal point and the louver member.

The complete test program was designed to allow for a statistical evaluation of the effect of all of these processing parameters on crack formation, as well as their possible interactions. Metallographic examination of test specimens which were produced for this program revealed that varying the specific laser operating parameters had relatively little effect on the propensity for cracking along the grain boundaries of the base metal. Rather, it was determined that the variable which had the overwhelming effect on the formation of base metal cracks in laser pierced Hastelloy X was the microstructure of the base metal prior to the piercing operation. More specifically, cracking associated with the laser piercing operation was most dependent upon the grain size and the associated grain boundary morphology in the Hastelloy X materials; the propensity for cracking was found to increase with increasing grain size (decreasing ASTM No.).

This conclusion was in agreement with tests which indicated that low cycle fatigue life also decreased with increasing grain size. The tests were conducted in reverse bending mode, at 425° C. (800° F.), ±0.5% strain, and 870° C. (1,600° F.), ±0.25% strain. These test conditions are considered to represent the approximate temperature range for a combustor operating in a gas turbine engine, with the strain conditions chosen to cause specimen failure in a reasonable period of time. Results of these tests are presented in Tables I and II. This data indicates that fatigue life decreased with increasing grain size; the relationship was observed at both test temperatures.

As a result of these tests, it was concluded that it was necessary to revise the fabrication process of the louver members such that their microstructure would be characterized by a small grain size prior to the laser piercing operation. As discussed above, since cracking was observed on louver members having a pre-pierceing grain size of ASTM No. 4–8, the revised grain size would have to be smaller i.e., have a larger ASTM grain size number. However, any revision in the louver member fabrication was subject to the proviso that the louver member microstructure be easily transformable after the laser piercing operation back to the desired grain size of ASTM No. 4–8. As is noted above, such a grain size provides the best balance of fatigue strength and creep strength for a combustor louver member.

Figure 1B:
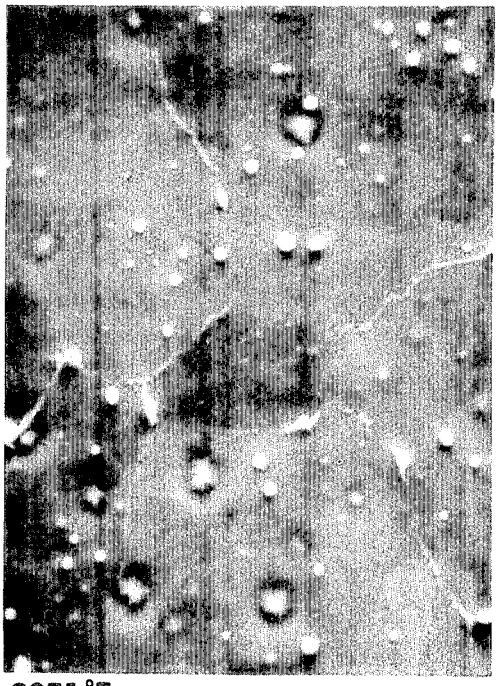
FIG. 1*b* is a photomicrograph (2000X) of a HASTELLOY Alloy X louver member heat treated at about 1,135° C.
Figure 1C:
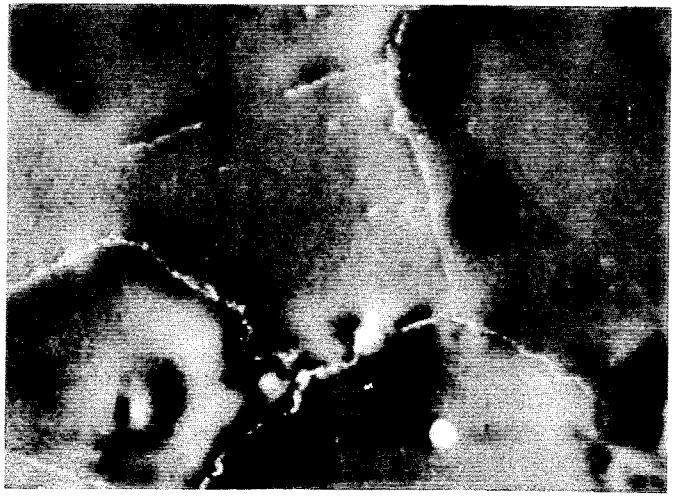
FIG. 1*c* is a photomicrograph (2000X) of a HASTELLOY Alloy X louver member heat treated at about 1,180° C.

It has now been determined that during the fabrication of the subdetails, in-process anneals at 1,020°–1,050° C. for about 15 minutes will consistently produce a small grain size in the Hastelloy X material, within the range of ASTM No. 6–9. Such a thermal treatment also produces a discontinuous distribution of carbide phase precipitate particles along the grain boundaries, as shown in FIG. 1*a*. Heat treating at higher temperatures such as 1,135° C. and 1,180° C., results in a more coarse grain size, and a more continuous carbide film along the grain boundaries (FIGS. 1*b* and 1*c*). Precipitates in the matrix, which do not appear to have any effect on intergranular cracking, are shown in all of the Figures. The continuous carbide film of FIGS. 1*b* and 1*c* may provide an easy path for crack propagation compared to the discrete carbide particle distribution shown in FIG. . 1*a*, and as such, is undesirable. It was found that in the condition shown in FIG. 1*a*, (i.e., ASTM grain size No. 6–9, discontinuous carbide film) the louver members may be laser pierced with little or no cracks initiating at the holes. After the laser piercing operation, the louver members can be heat treated at about 1,135°–1,160° C. (2,075°–2,125° F.) for about one hour to restore the desired ASTM No. 4–8 grain size.

To illustrate the fabrication of a combustor according to the process described above, the following example is provided. This example is meant to be illustrative, rather than limiting. Hastelloy X louver members were fabricated according to the teachings of U.S. Pat. No. 4,476,194, except that the in-process annealing during the fabrication of the louver member subdetails was conducted between 1,020°–1,050° C. for about 15 minutes. The subdetails were then circumferentially tungsten inert gas (TIG) welded to each other, to form the detail. The detail was contour rolled (about 20% reduction) to form the truncated cone louver member, and then annealed again at 1,020°–1,050° C. for 15 minutes to ensure a grain size of ASTM No. 6–9 and a discontinuous carbide phase precipitate along the grain boundaries. The louver members then had cooling holes pierced therein with a laser piercing system which was designed by the United Technologies Research Center (East Hartford, Conn.). The system utilized a Model TM21-6 laser built by the United Technologies Research Center. This particular model is a 6 kW rated, continuous wave, $CO_2$ recirculating gas, electric discharge excited laser. Also included in the overall system is a five axis computer numerically controlled machine tool built by Dallas Vaughan Associates/Comstock & Wescott (Boston, MA). The holes pierced had a typical diameter of about 2 mm and they were closely spaced apart from each other: the center of one hole to the center of the next adjacent hole was about 3.8 mm. In the area of the holes, the louver members were about 2.5 mm in thickness. After the holes were pierced, the louver members were circumferentially laser welded to form the combustor. A final heat treatment at 1,125°–1,175° C. for one hour resulted in the grain size in the Hastelloy X, including the TIG weld zone area, being within the desired range of ASTM No. 4–8.

Non-destructive inspection of combustors fabricated according to the method described above revealed that the grain size was within the acceptable limits, and that there was little or no cracking in the cooling hole areas.

It is expected that the above described process will be useful on other combustor alloys besides Hastelloy X. Some of these alloys may include, e.g., INCONEL® Alloy 617 (typical composition, by weight percent, 22.0 Cr, 12.5 Co, 9.0 Mo, 1.5 Fe, 1.2 Al, 0.5 Mn, 0.5 Si, 0.3 Ti, 0.2 Cu, 0.01 C, 0.008 S, balance Ni), HAYNES® Alloy 188 (typical composition, by weight percent, 22 Cr, 22 Ni, 14.5 W, 3 Fe, 1.25 Mn, 0.08 La, 0.35 Si, 0.1 C, balance Co), and the alloy designated MERL 72 (typical composition, by weight percent, 25 Cr, 15 Ni, 9 W, 4 Al, 3 Ta, 1 Hf, 0.2 Ti, 0.4 Y, balance Co). INCONEL and HAYNES are registered trademarks of the International Nickel Company, Inc., and Cabot Corporation, respectively, while MERL 72 is an alloy designation of Pratt & Whitney (East Hartford, Conn.).

The present invention is not restricted to the piercing of holes with a laser. Other types of high energy sources, such as an electron beam source, will be useful.

Although the invention has been shown and described with respect to a preferred embodiment thereof, it should be understood by those skilled in the art that other various changes and omissions in the form and detail thereof may be made therein without departing from the spirit and scope of the invention.

TABLE I

Effect of Grain Size on the Fatigue Life of AMS 5536 at 427° C. and +0.5%

| ASTM Grain Size No.* | Fatigue Life (Cycles) |
|---|---|
| −0.5 | 5,671 |
| −0.5 | 6,150 |
| −0.6 | 6,063 |
| 0.4 | 6,448 |
| −1.0 | 5,735 |
| −0.4 | 5,523 |
| 1.6 | 6,895 |
| 1.2 | 7,405 |
| 1.2 | 6,706 |
| 1.1 | 5,957 |
| 1.3 | 6,623 |
| 0.8 | 7,723 |
| 2.0 | 7,765 |
| 2.8 | 8,539 |
| 2.3 | 8,908 |
| 2.9 | 8,274 |
| 4.0 | 8,521 |
| 2.2 | 7,898 |
| 5.3 | 10,377 |
| 5.6 | 11,359 |
| 5.7 | 8,798 |
| 5.4 | 9,797 |
| 5.5 | 10,407 |
| 5.7 | 8,638 |
| 7.8 | 14,095 |
| 7.6 | 12,857 |
| 7.8 | 9,346 |
| 7.8 | 11,994 |
| 7.3 | 10,352 |

TABLE I-continued

| Effect of Grain Size on the Fatigue Life of AMS 5536 at 427° C. and +0.5% | |
|---|---|
| ASTM Grain Size No.* | Fatigue Life (Cycles) |
| 7.7 | 11,832 |

*Grain size measured by the line intercept method (per ASTM E-112) in the vicinity of failure.

TABLE II

| Effect of Grain Size on the Fatigue Life of AMS 5536 at 870° C. and +0.25% | |
|---|---|
| ASTM Grain Size No.* | Fatigue Life (Cycles) |
| −0.5 | 3,081 |
| −0.4 | 2,889 |
| −0.4 | 1,564 |
| −0.6 | 1,848 |
| 0.2 | 2,780 |
| −0.4 | 2,440 |
| 0.5 | 3,561 |
| 0.5 | 3,887 |
| 0.5 | 3,579 |
| 1.4 | 2,969 |
| 1.0 | 4,081 |
| 0.4 | 4,188 |
| 1.3 | 3,160 |
| 2.6 | 4,250 |
| 2.3 | 4,080 |
| 3.1 | 4,210 |
| 3.7 | 4,207 |
| 4.0 | 4,246 |
| 6.1 | 3,496 |
| 5.4 | 4,297 |
| 5.4 | 6,744 |
| 5.3 | 5,328 |
| 7.9 | 7,822 |
| 7.5 | 6,133 |
| 7.7 | 4,158 |
| 8.2 | 5,445 |
| 7.8 | 8,214 |
| 7.5 | 7,505 |
| 7.8 | 4,790 |
| 7.6 | 5,666 |
| 7.8 | 6,028 |
| 8.0 | 5,480 |
| 7.8 | 5,670 |
| 7.6 | 5,730 |

*Grain size measured by the line intercept method (per ASTM E-112) in the vicinity of failure.

We claim:

1. A method for fabricating a wrought, polycrystalline, carbon containing superalloy article having a plurality of small diameter, closely spaced apart holes therein, wherein the article is a nickel or cobalt base material, and has good fatigue strength and creep strength, comprising the steps of:

(a) first heat treating the article to produce therein an average grain size of ASTM No. 6–9 and a substantially discontinuous carbide phase precipitate along the boundaries of said grains;

(b) piercing the holes in the article with a high energy beam; and then (c) second heat treating the article to produce therein an average grain size of ASTM No. 4–8.

2. The method of claim 1, wherein the superalloy article consists essentially of, by weight percent, 20.5–23 Cr, 0.5–2.5 Co, 17–20 Fe, 8–10 Mo, 0.2–1.0 W, 0.05–0.15 C., with the balance Ni, and wherein said first step of heat treating takes place at 1,020°–1,050° C. for about 15 minutes, and said second step of heat treating takes place at 1,135°–1,160° C. for about one hour.

3. The method of claim 2, wherein said holes are about 2 mm in diameter, and the distance from the center of one hole to the center of the next adjacent hole is about 3.8 mm.

4. The method of claim 1, wherein the typical composition of the superalloy article is 22 Cr, 22 Ni, 14.5 W, 3 Fe, 1.25 Mn, 0.08 La, 0.35 Si, 0.1 C, with the balance Co.

5. A method for fabricating a combustor for a gas turbine engine, said combustor comprising a plurality of annular louver members, each member being a wrought, polycrystalline, carbide forming alloy, the members welded together so as to form a hollow combustion chamber, each member having a plurality of small diameter, circumferentially disposed and closely spaced apart holes therein to admit cooling air into the chamber, said method comprising the steps of:

(a) providing a plurality of individual louver members;

(b) heat treating each member to produce therein an average grain size of ASTM No. 6–9 and a substantially discontinuous carbide phase precipitate along the boundaries of said grains;

(c) piercing the holes in each member with a high energy laser beam, the holes disposed circumferentially about each member;

(d) welding the members together to form the combustor; and (e) heat treating the combustor to produce therein an average grain size of ASTM 4–6.

6. The method of claim 5, wherein said step of heat treating each louver member takes place at 1,020°–1,050° C. for about 15 minutes.

7. The method of claim 6, wherein said step of heat treating the combustor takes place at 1,135°–1,160° C. for about one hour.

8. The method of claim 7, wherein said louver members consist essentially of, by weight percent, 20.5–23 Cr, 0.5–2.5 Co, 17–20 Fe, 8–10 Mo, 0.2–1.0 W, 0.05–0.15 C., with the balance Ni.

9. An article made by the method of claim 8.

10. A hollow combustor for a gas turbine engine comprising a plurality of welded together annular louver members, each member having a plurality of small diameter, circumferentially disposed and closely spaced apart holes therein to admit cooling air into the chamber, said combustor made by the method which comprises the steps of:

(a) providing a plurality of individual louver members, each member being a wrought, polycrystalline, carbide forming alloy which consists essentially of, by weight percent, 20.5–23 Cr, 0.5–2.5 Co, 17–20 Fe, 8–10 Mo, 0.2–1.0 W, 0.05–0.15 C, with the balance Ni;

(b) heat treating each member at about 1,020°–1,050° C. for about 15 minutes to produce therein an average grain size of ASTM No. 6–9 and a substantially discontinuous carbide phase precipitate along the boundaries of said grains;

(c) piercing the holes in each member with a high energy laser beam;

(d) welding the members together to form the combustor; and (e) heat treating the combustor at about 1,350°–1,160° C. for about one hour to produce therein an average grain size of ASTM 4–6.

* * * * *